United States Patent [19]

Komori et al.

[11] Patent Number: 4,836,103

[45] Date of Patent: Jun. 6, 1989

[54] CYLINDER APPARATUS OF SHEET-FED ROTARY PRESS

[75] Inventors: Tatsuo Komori; Hiroyuki Sugiyama, both of Toride, Japan

[73] Assignee: Komori Printing Machinery Co., Ltd., Tokyo, Japan

[21] Appl. No.: 653,372

[22] Filed: Sep. 20, 1984

[30] Foreign Application Priority Data

Apr. 14, 1983 [JP] Japan ..... 58-65904

[51] Int. Cl.[4] ..... B41F 21/04

[52] U.S. Cl. ..... 101/231; 101/246; 101/409

[58] Field of Search ..... 101/246, 409, 410, 411, 101/412, 137, 142, 177, 231, 217, 416 R

[56] References Cited

U.S. PATENT DOCUMENTS

| | | | |
|---|---|---|---|
| 1,231,606 | 7/1917 | Henderson | 101/412 |
| 1,916,454 | 7/1933 | Wohlrabe | 101/142 |
| 2,004,136 | 6/1935 | Schultz | 101/415.1 |
| 2,088,862 | 8/1937 | Lang | 101/408 |
| 2,309,161 | 1/1943 | Breman et al. | 101/415.1 |
| 2,599,776 | 6/1952 | Peyrebrune | 101/409 |

*Primary Examiner*—Charles A. Pearson

*Attorney, Agent, or Firm*—Townsend & Townsend

[57] ABSTRACT

A cylinder apparatus of a sheet-fed rotary printing press having grippers which are pivotally supported inside a notch in a blanket cylinder brought into rolling contact with a plate cylinder and which is located in a vicinity of the leading edge of a printing plate on the plate cylinder, wherein phases of rotation of the plate and blanket cylinders are arranged such that the leading edge of the printing plate opposes a front end of the notch formed in the blanket cylinder which is located at a slightly advanced position with respect to a leading edge of the blanket, and a cam surface of a cam for opening/closing the grippers is shaped in such a manner that the grippers are kept opened when the leading edge of the printing plate opposes the front end of the notch formed in the blanket cylinder.

5 Claims, 3 Drawing Sheets

CYLINDER APPARATUS OF SHEET-FED ROTARY PRESS

BACKGROUND OF THE INVENTION

The present invention relates to a cylinder apparatus of a sheet-fed rotary press which transfers an image from a plate mounted on a plate cylinder to a blanket cylinder and further transfers the image to a sheet.

A blanket to blanket perfecting press is known as one type of sheet-fed printing press, wherein images are transferred from blanket cylinders to upper and lower surfaces of the sheet while the sheet passes between the blanket cylinders. The printing press of this type has upper and lower blanket cylinders which are brought into rolling contact with each other, and upper and lower plate cylinders respectively brought into rolling contact with the upper and lower blanket cylinders. One of the upper and lower blanket cylinders has grippers for receiving the sheet from a preceding transfer cylinder and then transferring same to a subsequent one.

FIG. 1 is a longitudinal sectional view of a cylinder apparatus of a conventional blanket to blanket perfecting press. Referring to FIG. 1, a printing plate 3 is mounted on a plate cylinder 1, and each end of the printing plate 3 is held by a plate lock up device 2 in a notch of the plate cylinder 1. A blanket 5 is mounted on a blanket cylinder 4 held in rolling contact with this plate cylinder 1, and each end of the blanket 5 is held by a metal member 6 disposed in a recess of the blanket cylinder 4. A gripper unit 9 having grippers 7 and gripper pads 8 is mounted inside the recess of the blanket cylinder 4 to transfer the sheet from the grippers of the upstream transfer cylinder to the grippers of the downstream transfer cylinder. The plate and blanket cylinders 1 and 4 are rotated along directions indicated by arrows A and B, respectively. Upon rotation of these cylinders, an image is transferred from the printing plate 3 to the blanket 5. The image is then transferred to the sheet passing between this blanket cylinder 4 and the lower blanket cylinder 4, thereby performing printing.

In the conventional cylinder apparatus as described above, when ink is applied to an image portion of the printing plate from form rollers in an inking unit, each of the form rollers abuts against the leading edge of the printing plate 3 so that the ink is applied thereto, as indicated by reference numeral 10. When the ink at the leading edge is transferred to the sheet, the sheet is contaminated. In this case, when phases of the cylinders 1 and 4 are slightly shifted along the circumferential direction in the broadside printing press so that the leading edge of the printing plate 3 which is applied with the ink opposes the notch in the blanket cylinder 4, the above problem can be solved. However, in the perfecting press, the grippers 7 interfere with such a phase shift between the cylinders 1 and 4. Therefore, in the conventional perfecting press, the sheet tends to be contaminated, thereby degrading the printing quality and producing spoilage.

SUMMARY OF THE INVENTION

It is an object of the present invention to provide a cylinder apparatus of a sheet-fed rotary printing press, wherein a leading edge of a printing plate which is applied with ink is not brought into contact with a blanket to prevent contamination of the sheet, thereby improving printing quality and decreasing spoilage.

In order to achieve the above object of the present invention, there is provided a cylinder apparatus of a sheet-fed rotary printing press having grippers which are pivotally supported inside a notch in a blanket cylinder brought into rolling contact with a plate cylinder and which is located in a vicinity of a leading edge of a printing plate on the plate cylinder, wherein phases of rotation of the plate and blanket cylinders are adjusted such that the leading edge of the printing plate opposes a front end of the notch formed in the blanket cylinder slightly at a downstream side of a leading edge of the blanket, as is best shown in FIG. 3, and a cam surface of a cam for opening/closing the gripper is shaped in such a manner that the grippers are kept opened when the leading edge of the printing plate opposes the front end of the notch formed in the blanket cylinder.

BRIEF DESCRIPTION OF THE DRAWINGS

FIGS. 2 to 4 show a cylinder apparatus of a sheet-fed rotary press according to an embodiment of the present invention, in which FIG. 2 is a side view showing the main part of the blanket to blanket perfecting press, FIG. 3 is a longitudinal sectional view showing a leading edge of a printing plate which opposes gripper pads (only one of which is shown), and FIG. 4 is a longitudinal sectional view showing the cylinder apparatus at a timing position slightly prior to that in FIG. 3.

DETAILED DESCRIPTION OF THE PREFERRED EMBODIMENT

Figure 2:
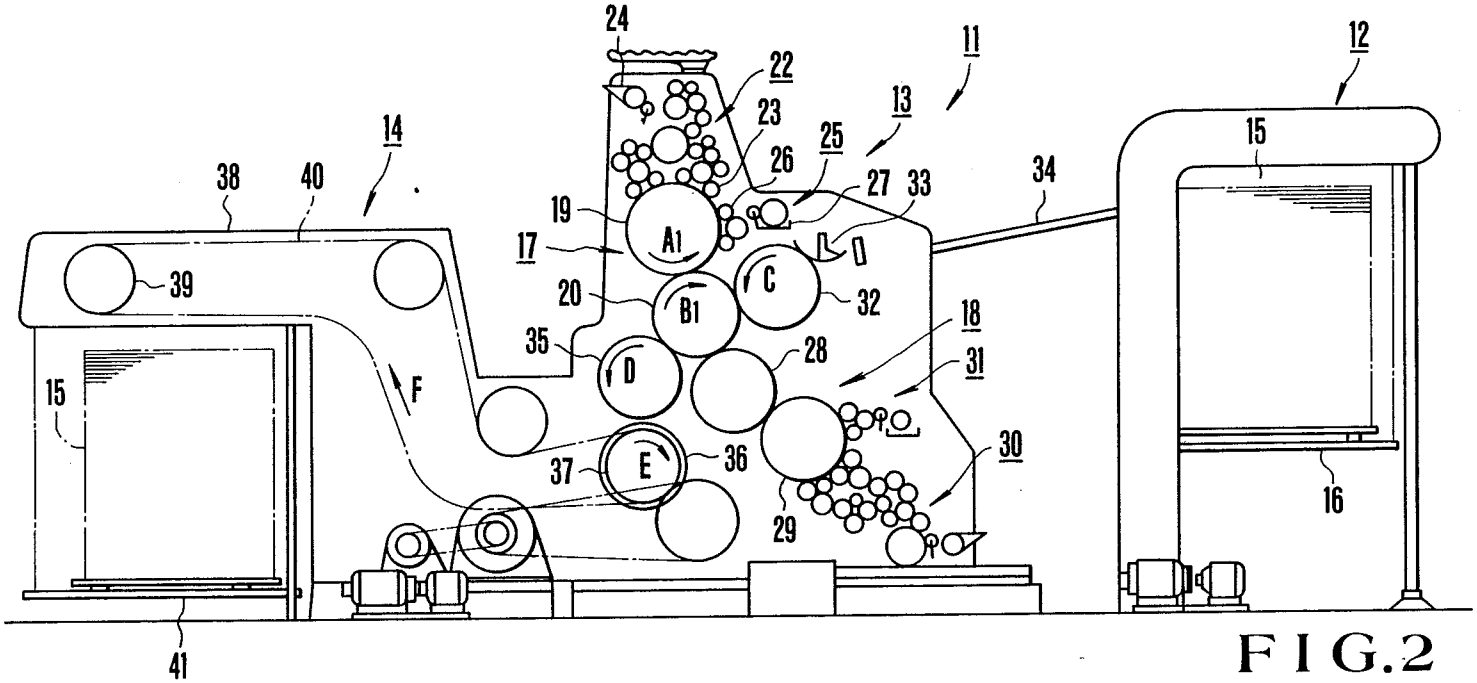

Referring to FIG. 2, a printing press 11 has an automatic feeder 12, a printing unit 13 and a delivery unit 14. A sheet stack table 16 is arranged in the automatic feeder 12 and is automatically moved upward upon feeding of sheets 15. An upper printing section 17 and a lower printing section 18 are vertically provided in the printing unit 13. A plate cylinder 19 and a blanket cylinder 20 are vertically arranged in the printing section 17 and are respectively rotated along directions indicated by arrows A1 and B1. A printing plate 21 is mounted on the plate cylinder 19 in such a manner that each end of the plate 21 is fixed by a plate lock up device 43 to be described later. A plurality of form rollers 23 in an inking unit 22 are brought into rolling contact with the surface of the printing plate 21. The inking unit 22 has an ink duct 24 for storing ink and a plurality of roller groups including the form rollers 23. The ink from the ink duct 24 is sufficiently distributed by distributing rollers or the like and is applied by the form rollers 23 to the surface of the printing plate 21. A pair of damping rollers 26 in a damping unit 25 are brought into rolling contact with the surface of the printing plate 1. Dampening water stored in a water reservoir 27 is supplied by the damping rollers 26 to the surface of the printing plate 21 through a plurality of rollers. The lower printing section 18 has a blanket cylinder 28 brought into rolling contact with the blanket cylinder 20, and a plate cylinder 29 brought into rolling contact with the blanket cylinder 28. An inking unit 30 and a damping unit 31 which are the same as those in the upper printing section 17 are arranged for the plate cylinder 29 in the lower printing section 18.

A transfer cylinder 32 having the same diameter as that of the blanket cylinder 20 is disposed at the upstream side of the upper blanket cylinder 20. The transfer cylinder 32 is rotated in the direction indicated by arrow C. A gripper unit 33 is arranged obliquely above the transfer cylinder 32. The sheet 15 is fed by the automatic feeder 12 one by one onto a feedboard 34 and is gripped by the grippers of the gripping unit 33. The sheet 15 is then transferred to the grippers of the transfer cylinder 32 and is wound therearound. A gripper unit 46 (to be described later) is mounted on the upper blanket cylinder 20 to transfer the sheet from the grippers of the transfer cylinder 32 to the blanket cylinder 20. A transfer cylinder 35 having the same diameter as that of the upper blanket cylinder 20 is arranged at the downstream side of the blanket cylinder 20. The transfer cylinder 35 is brought into rolling contact with the blanket cylinder 20 and is rotated in the direction indicated by arrow D. A delivery cylinder 36 is brought into rolling contact with the transfer cylinder 35 and is rotated in the direction indicated by arrow E. Reference numeral 37 denotes a pair of sprockets to be coaxial with the delivery cylinder 36. Right and left delivery chains 40 are looped between the pair of right and left sprockets 37 and a pair of right and left sprockets 39 disposed at the end portion of a delivery frame 38, respectively. The delivery chains 40 travel in the direction indicated by arrow F. A plurality of gripper shafts are mounted across the right and left delivery chains 40. A plurality of grippers are mounted on each of the gripper shafts to axially extend parallel to each other. Reference numeral 41 denotes a stacker for receiving the sheets 15 released and dropped from the grippers on the delivery chains 40. The stacker 41 is moved downward in accordance with an increase in the number of stacked sheets 15.

Figure 4:
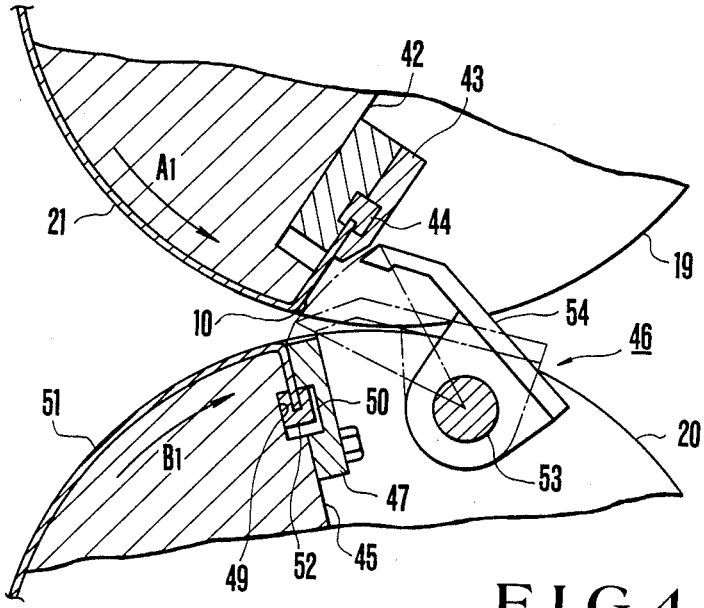
Figure 3:
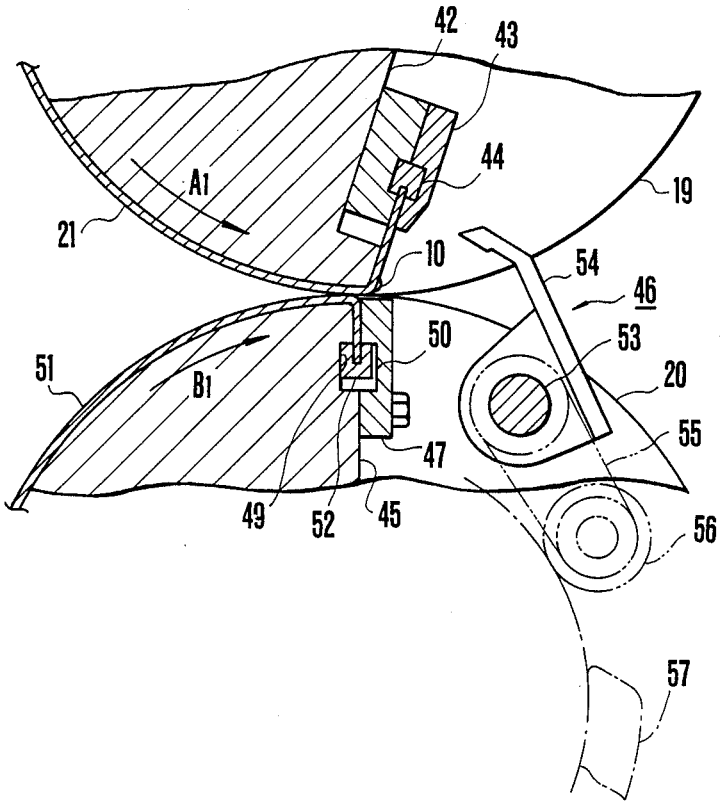

The positional relationship between the plate cylinder 19 and the blanket cylinder 20 will be described more in detail with reference to FIG. 3. The split plate lock up device 43 is fixed on a notch wall surface 42 of the plate cylinder 19. A holder 44 fixed at one end of the printing plate 21 is supported by the plate lock up device 43. The angle between an arcuate portion of the printing plate 21 and a linear portion extending toward the holder 44 is smaller than that in the conventional press, as is apparent from a comparison between the devices shown in FIGS. 1 and 3. Another plate lock up device is fixed at the other end of the printing plate 21. Gripper pads 47 of the gripper unit 46 are fixed by bolts 48 on a notch wall surface 45 of the blanket cylinder 20. A holder 52 fixed at one end of a blanket 51 is fitted in grooves 49 and 50 which are respectively formed in the notch wall surface 45 and each of the gripper pads 47. The blanket 51 is wound around the blanket cylinder 20. Another holder fixed at the other end of the blanket 51 is held in the notch. The leading edge of the printing plate 21 is slightly advanced from the leading edge of the blanket 51 with respect to the rotational directions A1 and B1. In other words, the phases of the cylinders 19 and 20 are determined such that the leading edge of the printing plate 21 opposes the gripper pads 47. In addition, in order to prevent an interference between the leading edge of the printing plate 21 and the gripper pads 47, the end face of each of the gripper pads 47 has a lower level than that of the surface of the blanket cylinder 20. A gripper shaft 53 is mounted in the recess of the blanket cylinder 20 along the entire length of the blanket cylinder 20. Grippers 54 are mounted on the gripper shaft 53 along the axial direction thereof to extend parallel to each other and respectively correspond to gripper pads 47. A roller lever 55 is fixed at an end of the gripper shaft 53. A cam follower 56 rotatably mounted at the free end of the lever 55 is brought into rolling contact with a cam surface of a gripper opening/closing cam 57 fixed on the press frame by means of a spring member (not shown). When the cylinders 19 and 20 are rotated, the grippers 54 are brought into contact with or separated from the corresponding gripper pads 47 upon interaction between the gripper opening/closing cam 57 and the cam follower 56. In this embodiment, the gripper unit is of "cam close" type. The grippers 54 are brought into contact with the corresponding gripper pads 47 when the cam follower 56 is moved from the small-diameter portion to the large-diameter portion of the cam 57. However, when the cam follower 56 is moved from the large-diameter portion to the small-diameter portion of the cam 57, the grippers 54 are separated from the gripper pads 47 by the biasing force of the spring member. As is apparent from a comparison of the states shown in FIGS. 3 and 4, the grippers 54 in the state shown in FIG. 3 have completed sheet transfer to the gripper of the downstream transfer cylinder 35, and is about to grip the sheet from the grippers of the upstream transfer cylinder 32. The grippers 54 may remain open in this state. In this embodiment, the grippers 54 are open in this state. FIG. 4 shows a rotational timing position slightly prior to the state shown in FIG. 3. In other words, FIG. 4 shows a state prior to a time when the leading edge of the printing plate 21 opposes the front end of the notch of the blanket cylinder 20. In this embodiment, a valley portion is formed on the cam surface of the gripper opening/closing cam 57 such that the grippers are open in the state shown in FIG. 4. Alternatively, the cam follower 56 may be brought into rolling contact with only a large-diameter portion of the gripper opening/-closing cam 57 which does not have a small-diameter portion.

The operation of the printing press having the arrangement described above will be described. The sheets 15 placed on the sheet support 16 are fed one by one by a sucker in the automatic feeder 12. Each of the sheets is thus fed onto the feedboard 34 and is gripped by the grippers of the gripper unit 33. The sheet is transferred to the grippers of the transfer cylinder 32 and is wound therearound. When the respective cylinders are rotated and the grippers of the transfer cylinder 32 oppose the grippers 54 of the upper blanket cylinders 20, the grippers thereof are closed to grip the sheet 15. When the respective cylinders are further rotated and the sheet 15 passes between the upper and lower blanket cylinders 20 and 28, images are printed on the two opposite surfaces of the sheet, respectively. The printed sheet 15 is then transferred from the grippers 54 of the blanket cylinder 20 to the grippers of the transfer cylinder 35. The transferred sheet is further transferred from the grippers of the transfer cylinder 35 to the grippers on the delivery chains 40 and is conveyed along the direction indicated by arrow F. At the end of the convey path, the sheet is released from the grippers and drops onto the stacker 41.

In the printing operation described above, the ink is supplied from the form rollers 23 in the inking unit 22 to the printing plate 21. In this case, as previously described, the form rollers 23 abut against the leading edge of the printing plate 21, so that the ink is also applied to the leading edge. This leading edge is brought into contact with the outer surface of the blanket cylinder 20. In the conventional cylinder apparatus, the ink from the leading edge is also applied to the blanket cylinder 20. However, in the apparatus according to the present invention, the phase of rotation of the plate cylinder 19 is advanced with respect to that of the blanket cylinder 20 along the rotational direction A1, so that the leading edge opposes the gripper pads 47. In addition, the level of each of the gripper pads is lower than that of the outer surface of the blanket cylinder 20. As a result, the ink 10 will not be applied to the surface of the blanket 51. Furthermore, as shown in FIG. 4, the angle between the leading edge of the printing plate 21 and the arcuate body portion of the printing plate 21 is decreased (when compared to the conventional apparatus of FIG. 1), and a plate lock up device 43 is notched so as not to interfere with opening/closing of the grippers 54. The grippers 54 are kept opened from the sheet release position opposing the transfer cylinder 35 to a sheet gripping position opposing the transfer cylinder 32.

Figure 1:
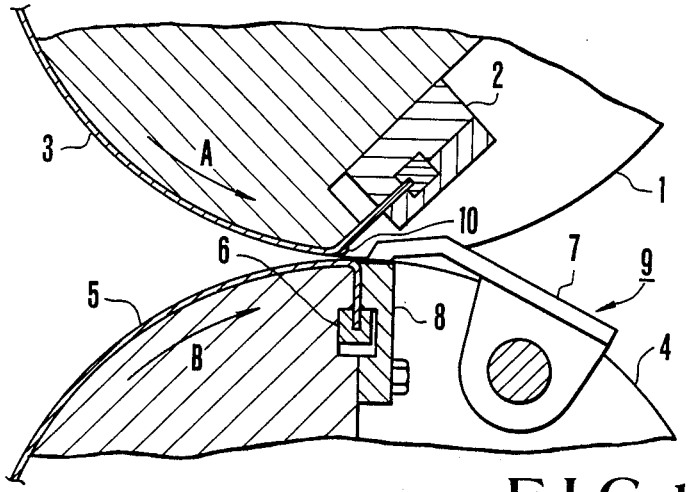
FIG. 1 is a longitudinal sectional view of a cylinder apparatus of a conventional blanket to blanket sheet-fed rotary press.

When the gripper opening/closing cam 57 comprises a partial cam having only the large-diameter portion, a special cam for closing the grippers 54 so as to prevent them from interfering with the leading edge of plate 21 must be arranged in the conventional apparatus shown in FIG. 1. However, according to the cylinder apparatus of the present invention, such a cam need not be used. In this embodiment, a gripper opening/closing cam 57 of the "cam close" type is used. However, a gripper opening/closing cam of "spring close" type may be used. In this case, the grippers 54 are opened when the cam follower is brought into rolling contact with the large-diameter portion of the cam. However, the grippers 54 are closed by the biasing force when the cam follower is brought into rolling contact with the small-diameter portion thereof. Therefore, the gripper closing cam can be removed. However, the gripper opening/closing cam of the "cam close" type is adopted at present in favor of high-speed adjustment. High performance of the apparatus of the present invention can be expected.

As has been apparent from the above description, in the cylinder apparatus of a sheet-fed rotary printing press, the phase of rotation of the plate cylinder is aligned with that of the blanket cylinder such that the leading edge of the plate cylinder opposes the front end of the notch of the blanket cylinder at a point slightly downstream of the leading edge of the blanket cylinder as viewed from the direction of rotation of the plate cylinder. The cam surface of the cam has a shape such that the grippers of the blanket cylinder are kept opened when the leading edge of the printing plate opposes the front end of the recess. Even if the ink is applied to the leading edge of the printing plate when the form rollers are brought into contact with the leading edge thereof, the ink will not be transferred to the leading edge of the blanket on the blanket cylinder. The sheet will not be contaminated with the ink, thereby improving printing quality and decreasing spoilage. In addition, the phase of rotation of the plate cylinder can be advanced with respect to that of the blanket cylinder without fear of interference between the leading edge of the printing plate and the grippers of the blanket cylinder, so that an unprinted portion of the sheet can be decreased. The cam to close the grippers when the leading edge of the printing plate opposes the front end of the notch of the blanket cylinder need not be employed. Even if the "cam close" type cam is used to open/close the grippers, the manufacturing cost of the cam can be decreased.

What is claimed is:

1. In a cylinder apparatus of a sheet-fed blanket-to-blanket perfecting rotary printing press having grippers which are pivotally supported inside a recess in a blanket cylinder having a blanket brought into rolling contact with a plate cylinder and which are located in the vicinity of a leading edge of a printing plate on said plate cylinder the improvement wherein phases of rotation of said plate and blanket cylinders are arranged such that the leading edge of said printing plate opposes a trailing end of the recess formed in said blanket cylinder at an advanced position with respect to a leading edge of said blanket, and a cam surface of a cam for controlling the operative position of said grippers is shaped in such a manner that said grippers are kept opened when said leading edge of said printing plate opposes the trailing end of the recess formed in said blanket cylinder.

2. An apparatus according to claim 1, further including gripper pads mounted on a wall surface of said recess of said blanket cylinder and selectively brought into contact with said grippers; a gripper shaft mounted in said recess and having said grippers mounted thereon; a lever mounted at an end of said gripper shaft; and a cam follower rotatably mounted at a free end of said lever and arranged in rolling contact with a cam surface of said cam.

3. An apparatus according to claim 2, wherein said grippers are brought into contact with said gripper pads when said cam follower is moved from a small-diameter portion to a large-diameter portion of said cam, and said grippers are separated from said gripper pads when said cam follower is moved from said large-diameter portion to said small-diameter portion.

4. An apparatus according to claim 3, wherein each of said gripper pads has a lower level than that of an outer surface of said blanket.

5. An apparatus according to claim 4, wherein the leading edge of said printing plate is bent at an angle with respect to the surface of said printing plate to avoid mechanical interference with said grippers.

* * * * *